US007909738B2

(12) United States Patent
Chen

(10) Patent No.: US 7,909,738 B2
(45) Date of Patent: Mar. 22, 2011

(54) TRAMPOLINE SWING

(76) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 12/082,615

(22) Filed: Apr. 11, 2008

(65) Prior Publication Data

US 2009/0258759 A1 Oct. 15, 2009

(51) Int. Cl.
*A63B 21/00* (2006.01)

(52) U.S. Cl. ..... 482/27; 482/28; 482/23; 472/117; 472/119; 114/264

(58) Field of Classification Search ..... 472/117–119, 472/116; 482/35, 27, 28, 23, 128; 114/264
See application file for complete search history.

(56) References Cited

U.S. PATENT DOCUMENTS 2,977,118 A * 3/1961 Farkas ..... 482/35
4,256,300 A * 3/1981 Boucher ..... 472/118
5,674,157 A * 10/1997 Wilkinson ..... 482/83
2003/0196580 A1* 10/2003 Broderick et al. ..... 114/264
2006/0223676 A1* 10/2006 Rote ..... 482/27

* cited by examiner

*Primary Examiner* — Jerome W Donnelly
(74) *Attorney, Agent, or Firm* — Clement Cheng

(57) ABSTRACT

A trampoline swing has a swing assembly, a trampoline assembly and a trampoline to swing connection member connecting the horizontally oriented trampoline frame to a trampoline connection end of the swing assembly. The trampoline swing has a top bar having a pair of apexes, namely a left apex and a right apex. The left apex is at a left side of the swing assembly and the right apex is at the right side of the swing assembly. There are four main body leg supports, namely a front left leg support, a front right leg support, a rear left leg support, and a rear right leg support. The left apex receives the front left leg support and the rear left leg support. The right apex receives the front right leg support and the rear right leg support. A plurality of swing connectors are mounted on the top bar.

19 Claims, 1 Drawing Sheet

TRAMPOLINE SWING

DISCUSSION OF RELATED ART

Childhood is a precious time in every person's life. For some children, lazy summer afternoons playing in the backyard persist as a fond memories for a lifetime. Central to many backyard play scenes is the backyard swing set which to some is as nostalgic as summertime lemonade and running barefoot in the grass. Over the decades, many inventors have tried to improve the backyard swing set.

The backyard swing set is typically a frame structure supporting swing. The frame structure is typically steel tubing welded or bolted together to provide a stable swing. Typically, chains are hung from the frame structure that attach to seats. Although the backyard swing set has been classically entertaining for decades, it could be improved as many inventors have proven.

The backyard swing set has been improved upon for decades. Some earlier improvements would include U.S. Pat. No. 1,687,408 to W. O. T. Watkins for improving swing safety with a limiting bar. U.S. Pat. No. 1,340,904 to P. S. Medart provides for a swing safety grip with tubing and tube caps over the chain. The backyard swing set has also been improved to have swinging and gliding such as that shown in the U.S. Pat. No. 2,307,141 to E. W. Ladd. Also, methods of swinging have been patented, such as swinging side to side as described in U.S. Pat. No. 6,368,227 to Steven Olson. Purely structural inventions have also been patented such as U.S. Pat. No. 4,094,503 to Wormser providing an extruded high-strength crossbar. In any case, most of the different swing improvement patents have not had much commercial success, and centuries old designs still prevail in the marketplace. Recently, it has been fashionable to have swing frames made of wood for example.

SUMMARY OF THE INVENTION

The invention comprises a frame supporting a swing assembly and a trampoline assembly proximately attached thereto. Optionally, a slide assembly can be added. The trampoline assembly is connected to the swing assembly. The trampoline has a trampoline bed stretched over a trampoline frame via springs. The trampoline pad fits over the trampoline frame and bed.

The trampoline bed assembly includes a retaining mesh like screen that is preferably slightly elastic to retain users on the trampoline bed. Above the retaining mesh screen is a banner that can display a glossy logo or theme. The trampoline bed has a trampoline pad around the trampoline frame. One end of the trampoline frame is connected to the swing assembly and the other end of the trampoline frame is connected to a plurality of upright handles. The upright handle or handle uprights are rigid, preferably made of hollow steel tubing and come together at a handle apex. A portion of the upright handles or handle apex receives a handle padding. The handle padding is formed as a foam cushion sliding over the hollow steel tubing.

The connection between the trampoline frame and the swing assembly is via a socket connector. The socket connector has a collar portion attaching to base footing and a trampoline connection portion connected to the trampoline frame. The trampoline assembly preferably includes trampoline leg supports hidden behind trampoline legs skirts. The trampoline legs skirts extend from an upper end starting at the trampoline pad, and may reach to the ground.

Regarding the swing assembly, a variety of swing connectors are connected to the top bar. The top bar has apex connector bolts that attach to main body leg supports. The main body leg supports further have at least one stabilizing crossbar. Swing handles hanging from the swing connectors support swing seats for user. In addition to traditional swings, a double swing having the form of a double swing seat can also be installed to connect to the top bar. Typically, two or three swing elements are suspended from the top bar. The main body leg supports join at an apex and are secured with apex connector bolts. The main body leg supports are typically made of metal tubing and also have support padding in the form of a foam sleeve for cushion.

Furthermore, a slide assembly having a slide contour with raised edges, preferably thermoplastic formed or injected molded as a piece of plastic is attached to an end of the swing assembly. It is an object of the invention to provide a trampoline and swing combination play set that is more fun to play with.

Figure 1:
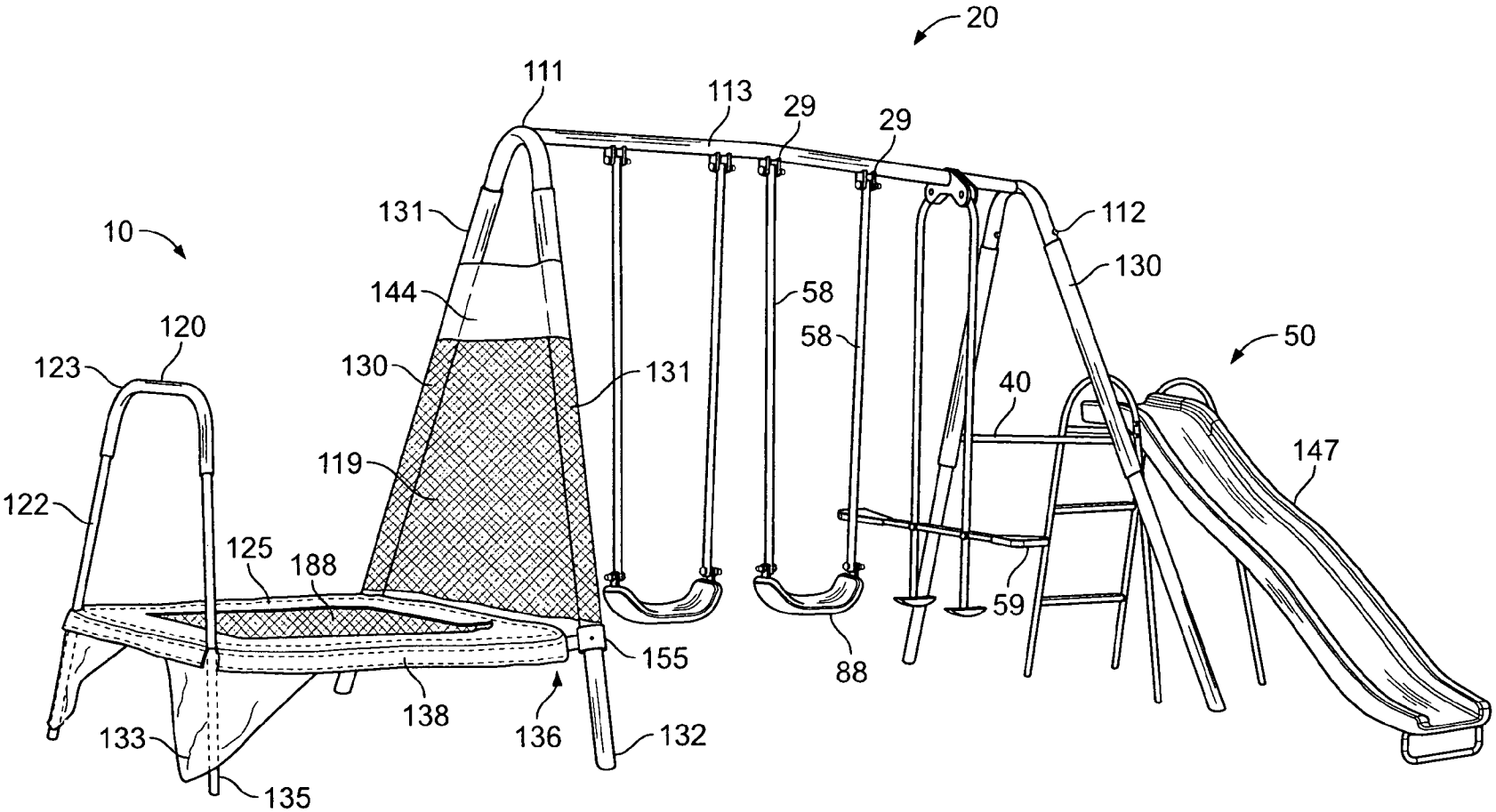
FIG. 1 is a perspective view of the present invention.

The following call out list of elements may assist the reader in referencing elements.

10 Trampoline Assembly
20 Swing Assembly
29 Swing Connector
40 Stabilizing Crossbar
50 Slide Assembly
58 Swing Handles
59 Double Swing
88 Swing Seat
111 Apex
112 Apex Connector Bolt
113 Top Bar
119 Retaining Mesh
120 Handle Padding
122 Handle Upright
123 Handle Apex
125 Trampoline Pad
130 Main Body Leg Support
131 Support Padding
132 Base Footing
133 Trampoline Leg Skirt
135 Trampoline Leg Support
136 Strap Tie Connector
138 Horizontally Oriented Trampoline Frame
144 Top Banner
147 Slide Contour
155 Socket Connector
188 Trampoline Bed

DETAILED DESCRIPTION OF THE PREFERRED EMBODIMENT

The invention comprises a frame supporting a swing assembly 20 and a trampoline assembly 10 proximately connected thereto. As seen in FIG. 1, the trampoline assembly 10 is attached to the right side of the swing assembly. The trampoline assembly 10 can also be attached to the left side. Optionally, a slide assembly 50 can be secured to the swing assembly 20 on the opposite side of the trampoline assembly 10. The trampoline assembly 10 is preferably connected to the swing assembly at a lower portion of the swing assembly 20. On the other hand, the slide assembly 50 is preferably attached to the midpoint height portion of the swing assembly 20.

Regarding the swing assembly 20, a variety of swing connectors 29 are connected to the top bar 113. The top bar is preferably made of metal tubing and welded to have a total of four sockets, each receiving a main body leg support 130. Each of the four main body leg supports slide into connection with the top bar. The top bar forms an apex 111 at each side. Each apex on each side of the top bar receives a pair of main body leg supports 130. Main body leg supports 130 are also preferably metal tubes. The upper end of each main body leg support 130 mates with the socket of the apex. For securing the connection, apex connector bolts 112 should pass through the diameter of the main body leg support 130. The main body leg supports may be coated with a finish such as ultraviolet resistant nontoxic paint, powder coating, or the like for environmental wear resistance. Each main body leg support padding 131 further protects the main body leg supports 130 from environmental wear. The main body leg support padding 131 is also formed as a sleeve having a padding thickness, and wrapping around a main body leg support. The padding thickness is preferably about 1-3 cm. The main body leg support padding 131 may extend higher to cover the apex connector bolts 112 as shown on the right side of FIG. 1, or the main body leg support padding may end before the height of the apex connector bolts 112, leaving the apex connector bolts 112 exposed.

The main body leg supports further have at least one stabilizing crossbar 40. The crossbar 40 is also preferably a metal tube and connects between main body leg supports 130. The crossbar 40 is preferably placed on the side opposite the trampoline assembly 10. Therefore, the crossbar 40 may be similar in structure to the main body leg supports 130 that join at an apex 111 and are secured with apex connector bolts 112. The crossbar 40 is preferably of a smaller diameter than the main body leg supports 130. The main body leg supports 130 may also be of the same diameter and gage as the top bar 113. Also the main body leg supports 130 have support padding in the form of a foam sleeve for cushion.

The top bar 113 can be made as a metal tube, or steel extrusion such as that described in Wormser, the disclosure of which is incorporated herein by reference. The preferred method is to have a steel tube that has a peak in the middle, so that the peak rises above the a pair of apexes as shown in FIG. 1. The peak preferably defines a slight angular bend. The top bar 113 has a number of swing connectors 29 drawn as protruding flanges connected to nut and bolts in FIG. 1. The flanges receive bolts for securing swing handles 58 to the top bar 113. Swing handles 58 are shown as rigid links having a bolted connection at the top and bottom. The swing handles 58 can also be made of semi rigid material such as a chain encapsulated within a plastic tube as described in U.S. Pat. No. 1,340,904 to P.S. Medart the disclosure of which is incorporated herein by reference. Other semi rigid materials may include polyethylene, flexible metal, or any other commonly known link system. The material of the swing handles 58 could also be natural fiber rope, or chain in addition to the solid link shown in the drawing.

The swing seats 88 hanging from the swing handles 58. The swing seats 88 are preferably made of molded plastic. A double swing 59 can also be installed to connect to the top bar 113. The double swing 59 has a pair of opposing swing seats and a pair of opposing foot rests. The double swing 59 seats a pair of users.

The trampoline assembly 10 includes a screen 119 which is formed as a retaining mesh like divider that is preferably slightly elastic to retain users on the trampoline bed 118. The screen 119 could be made of the same material that the trampoline bed is made of, namely trampoline bed material. The screen is preferably see through. The screen can be multiple layer or single layer. The screen 119 is located on the trampoline connection end so that it wraps around and between the main body leg supports. The screen can be wrapped around one side or both sides of the main body leg support. If the screen is wrapped around both sides of the main body leg support, the diameter of the main body leg support forms a screen gap between the different layers of screen.

Above the retaining mesh screen is a banner 144 that can display a glossy logo or theme. The retaining mesh screen or screen 119 can be thermally laminated to the banner 144 by placing the mesh screen, or screen 119 for short against the banner 144 and applying heat so that the banner and screen attached to each other. The screen 119 is wrapped around the left front and left rear main body leg support after the support padding 131 is attached to the left front and left rear main body leg support. The screen has a bottom edge of approximately the height of the trampoline bed, extending upward to an upward edge which is beyond the height of a user jumping on the trampoline. The springs are preferably sized and proportioned for child users.

The trampoline bed 188 also has a trampoline pad 125 around the horizontally oriented trampoline frame 138. The trampoline pad 125 is preferably made of plastic foam and can be made in sections suitable for cushioning falling users and for supporting users stepping on the pad. The trampoline pad covers springs on the trampoline. A trampoline pad 125 fits over the gap between the trampoline frame 138 and the trampoline bed 180. This gap is caused by a spring area disposed between the trampoline frame and trampoline bed. The trampoline pad 125 extends around the periphery of the trampoline bed. The trampoline pad has a plastic foam core with an exterior cover.

One end of the trampoline frame 138 is connected to the swing assembly and the other end of the trampoline frame is connected to a plurality of upright handles. The end of the trampoline frame 138 connected to the swing assembly is the inside end and the end of the trampoline frame facing away from the swing assembly 20 is the outside end.

The upright handle 122 also called handle uprights are rigid, preferably made of hollow steel tubing and come together at a handle apex 123. The handle apex preferably forms a horizontal straight section between a pair of opposing upright sections. A portion of the upright handles 122 or handle apex 123 receives a handle padding 120. The handle padding 120 is formed as a foam cushion sliding over the hollow steel tubing of the handle apex 123. The upright handle 122 terminates at a bottom end trampoline leg support 135. The upright handle preferably has a diameter which is smaller than the diameter of the top bar 113.

The connection between the trampoline frame and the swing assembly can be accomplished by a wide number of hardware connection means. In any case, there is a trampoline to swing connection member. One method of connecting the trampoline frame to the swing assembly is via a socket connector 155 attached on the trampoline connection end of the swing assembly 20. The socket connector 155 is a connecting member that has a collar portion attaching to the base footing 132 and a trampoline connection portion connected to the trampoline frame. The collar portion is preferably made of metal and has a tightening means such as a set screw, or collar tightening bolt. Alternatively, the main body leg support 130 may have a protrusion or other increase in the diameter so that the collar portion rests upon the main body leg support. The collar portion is preferably a diecast piece. A pair of collar portions support a pair of corners of the horizontally oriented trampoline frame 138. An opposing pair of trampoline leg supports 135 support the opposing pair of corners. The preferred method of construction is to have bolted connections for most major members.

Another way of connecting the trampoline frame to the swing assembly is to have a direct welded in connection. Additionally, the trampoline frame may be bolted to the swing assembly. A number of hardware components are commercially available for connecting frames of different elements.

The trampoline assembly 10 preferably includes trampoline leg supports 135 hidden behind trampoline legs skirts. As seen in FIG. 1, the trampoline legs skirts are formed as triangular fabric sheets disposed on each outer corner of the trampoline assembly 10. The trampoline leg skirts extend from an upper end starting at the trampoline pad, and may reach to the ground.

Additional details regarding the device are made according to the prior art. For example, obvious modifications and additions such as adding endcaps or footings to the trampoline leg supports 135 would be known by persons of ordinary skill in the art. Although the trampoline taught is a rectangular and square trampoline, a similar trampoline could be attached that is circular.

Finally, a slide assembly 50 having a slide contour 147 with raised edges, preferably thermoplastic formed or injected molded as a piece of plastic is attached to an end of the swing assembly 20 opposite the trampoline assembly 10. The slide assembly 50 is preferably bolted to the swing assembly 20.

As seen in FIG. 1, the bolt shown as a dot on the connector 155 can also provide support by itself, or support along with connector 155.

Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A trampoline swing comprising:

a. a swing assembly comprising:

i. a top bar having a pair of apexes, namely a left apex and a right apex, wherein the left apex is at a left side of the swing assembly and the right apex is at the right side of the swing assembly;

ii. four main body leg supports, namely a front left leg support, a front right leg support, a rear left leg support, a rear right leg support, wherein the left apex receives the front left leg support and the rear left leg support, where the right apex receives the front right leg support and the rear right leg support;

iii. a plurality of swing connectors mounted on the top bar;

iv. at least one swing seat having swing handles mounted to the plurality of swing connectors;

b. a pair of connectors connected to two of the four main body leg supports of a trampoline connection end of the swing assembly;

c. a trampoline assembly connected to the pair of connectors comprising:

i. a horizontally oriented trampoline frame, supported by at least two of the four main body leg supports;

ii. a trampoline bed suspended across the horizontally oriented trampoline frame;

iii. a trampoline pad mounted above the horizontally oriented trampoline frame.

2. The trampoline swing of claim 1, further comprising: a slide assembly connected to either the left or right side of the swing assembly on an opposite side of the trampoline assembly.

3. The trampoline swing of claim 1, further comprising: a pair of upright handles extending from a pair of trampoline leg supports to connect with the horizontally oriented trampoline frame, wherein the pair of upright handles meet and join at a handle apex above the horizontally oriented trampoline frame.

4. The trampoline swing of claim 3, further comprising: a handle padding mounted on the handle apex, wherein the handle apex forms a horizontal section.

5. The trampoline swing of claim 3, further comprising: a pair of trampoline legs skirts mounted to cover the pair of trampoline leg supports.

6. The trampoline swing of claim 1, further comprising: a screen mounted pulled between two of the four main body leg supports of a trampoline connection end of the swing assembly.

7. The trampoline swing of claim 1, further comprising: a banner mounted over the screen.

8. The trampoline swing of claim 1, wherein the trampoline is rectangular.

9. The trampoline swing of claim 1, further comprising: a pair of upright handles extending from a pair of trampoline leg supports to connect with the horizontally oriented trampoline frame, wherein the pair of upright handles meet and join at a handle apex above the horizontally oriented trampoline frame; and a screen mounted pulled between two of the four main body leg supports of a trampoline connection end of the swing assembly.

10. A trampoline swing comprising:

a. a swing assembly comprising:

i. a top bar having a pair of apexes, namely a left apex and a right apex, wherein the left apex is at a left side of the swing assembly and the right apex is at the right side of the swing assembly;

ii. four main body leg supports, namely a front left leg support, a front right leg support, a rear left leg support, a rear right leg support, wherein the left apex receives the front left leg support and the rear left leg support, where the right apex receives the front right leg support and the rear right leg support;

iii. a plurality of swing connectors mounted on the top bar;

iv. at least one swing seat having swing handles mounted to the plurality of swing connectors;

b. a trampoline to swing connection member connecting the horizontally oriented trampoline frame to a trampoline connection end of the swing assembly;

c. a trampoline assembly connected to the pair of connectors comprising:

i. a horizontally oriented trampoline frame, supported by at least two of the four main body leg supports;

ii. a trampoline bed suspended across the horizontally oriented trampoline frame;

iii. a trampoline pad mounted above the horizontally oriented trampoline frame.

11. The trampoline swing of claim 10, further comprising: a slide assembly connected to either the left or right side of the swing assembly on an opposite side of the trampoline assembly.

12. The trampoline swing of claim 11, further comprising: a pair of upright handles extending from a pair of trampoline leg supports to connect with the horizontally oriented trampoline frame, wherein the pair of upright handles meet and join at a handle apex above the horizontally oriented trampoline frame.

13. The trampoline swing of claim 12, further comprising: a handle padding mounted on the handle apex, wherein the handle apex forms a horizontal section.

14. The trampoline swing of claim 12, further comprising: a pair of trampoline legs skirts mounted to cover the pair of trampoline leg supports.

15. The trampoline swing of claim 10, further comprising: a screen mounted pulled between two of the four main body leg supports of a trampoline connection end of the swing assembly.

16. The trampoline swing of claim 10, further comprising: a banner mounted over the screen.

17. The trampoline swing of claim 10, wherein the trampoline is rectangular.

18. The trampoline swing of claim 10, further comprising: a pair of upright handles extending from a pair of trampoline leg supports to connect with the horizontally oriented trampoline frame, wherein the pair of upright handles meet and join at a handle apex above the horizontally oriented trampoline frame; and a screen mounted pulled between two of the four main body leg supports of a trampoline connection end of the swing assembly.

19. The trampoline swing of claim 18, wherein the trampoline is rectangular.

* * * * *